US005909822A

United States Patent [19]

George et al.

[11] Patent Number: 5,909,822

[45] Date of Patent: Jun. 8, 1999

[54] PILL DISPENSER EMPLOYING A SEALED PILL CARRIER

[76] Inventors: Donald C. George, 4621 Via Gennita, Santa Barbara, Calif. 93111; Dean T. Upton, 2330 Las Canoas Rd., Santa Barbara, Calif. 93105

[21] Appl. No.: 08/850,578

[22] Filed: May 3, 1997

[51] Int. Cl.[6] ..... G07F 11/66

[52] U.S. Cl. ..... 221/25; 221/31; 206/531

[58] Field of Search ..... 221/30, 31, 185, 221/25, 26; 206/528, 531, 532, 535

[56] References Cited

U.S. PATENT DOCUMENTS

| | | | |
|---|---|---|---|
| 1,289,446 | 12/1918 | Griffiths | 141/370 |
| 1,485,716 | 3/1924 | Rogers | 206/535 |
| 2,763,956 | 9/1956 | Olson | 206/535 |
| 3,393,688 | 7/1968 | Severino | 221/185 |
| 3,688,945 | 9/1972 | Harmon et al. | 221/8 |
| 3,783,089 | 1/1974 | Hurst et al. | 161/166 |
| 4,054,208 | 10/1977 | Lowe | 206/537 |
| 4,101,029 | 7/1978 | Feinberg et al. | 206/315 B |
| 4,294,361 | 10/1981 | Margulies et al. | 206/532 |
| 4,381,059 | 4/1983 | Schurman | 206/533 |
| 4,588,090 | 5/1986 | Spuck et al. | 206/532 |
| 4,627,432 | 12/1986 | Newell et al. | 128/203.15 |
| 4,733,797 | 3/1988 | Haber | 221/31 |
| 4,778,054 | 10/1988 | Newell et al. | 206/531 |
| 4,905,866 | 3/1990 | Bartell et al. | 221/5 |
| 4,998,623 | 3/1991 | Doull | 206/531 |
| 5,019,125 | 5/1991 | Rebne et al. | 206/532 |
| 5,102,008 | 4/1992 | Kaufman et al. | 221/25 |
| 5,109,984 | 5/1992 | Romick | 206/531 |
| 5,118,007 | 6/1992 | Lewis et al. | 221/30 |
| 5,163,559 | 11/1992 | Bunin | 206/532 |
| 5,269,413 | 12/1993 | Stern | 206/535 |
| 5,318,824 | 6/1994 | Itaya et al. | 428/178 |
| 5,332,096 | 7/1994 | Battaglia | 206/532 |
| 5,348,158 | 9/1994 | Honan et al. | 206/531 |
| 5,356,010 | 10/1994 | Weinstein | 206/532 |
| 5,368,187 | 11/1994 | Poncetta et al. | 221/30 |
| 5,431,283 | 7/1995 | Weinstein et al. | 206/531 |
| 5,469,968 | 11/1995 | Matthews et al. | 206/532 |
| 5,486,390 | 1/1996 | Burns et al. | 428/40 |
| 5,522,506 | 6/1996 | Roulin et al. | 206/531 |

FOREIGN PATENT DOCUMENTS

| | | | |
|---|---|---|---|
| 3256876 | 11/1991 | Japan | 221/31 |

*Primary Examiner*—Kenneth Noland
*Attorney, Agent, or Firm*—Richard T. Lyon

[57] ABSTRACT

A pill dispenser including a pill carrier having multiple through-holes forming pill chambers. Each of these pill chambers holds, at least initially, a pill which is sealed from the outside environment and completely contained within the pill chamber. The dispenser also has a housing with a pill carrier slot into which the pill carrier resides. There is a pill dispensing channel forming a pathway from the slot to the exterior of the dispenser housing. The pill carrier is displaceable within the slot which allows each pill chamber to be sequentially aligned with the channel. A plunger apparatus is positioned adjacent the slot and opposite the channel and is extended into a pill chamber, then in alignment with the channel, so as to push a pill contained within the pill chamber into the channel for dispensing. In an alternate embodiment, the pill dispenser includes a pill carrier similar to the first embodiment. However, in this embodiment there are multiple pill dispensing channels forming individual pathways from the slot to the exterior of the dispenser housing, and multiple corresponding plungers. Each plunger is located adjacent said pill carrier slot and opposite a different one of said plurality of pill dispensing channels. In addition, the pill carrier is situated such that each of the pill chambers is in alignment a different one of the plurality of pill dispensing channels. In this way, each plunger is capable of extending into a pill chamber so as to push a pill contained within the pill chamber into a channel for dispensing.

51 Claims, 6 Drawing Sheets

PILL DISPENSER EMPLOYING A SEALED PILL CARRIER

BACKGROUND

1. Technical Field

This invention relates to an apparatus for dispensing medication in solid form, such as tablets, pills, capsules and the like, and particularly to such an apparatus which protects the medication from degrading influences while at the same time allowing the medication to be carried with a person at all times.

2. Background Art

Medication in solid form such as tablets, pills, capsules or the like (hereinafter collectively referred to as pills) must sometimes be carried with a person at all times. For example, a person who has angina pectoris needs to carry nitroglycerin pills in the case of an angina attack. The angina sufferer must immediately take a nitroglycerin pill orally when an attack occurs, and may need to take additional pills if the first is not successful in quelling the attack. Further, although not related to a condition causing an incapacitating attack, many people carry medication with them which must be taken regularly for convenience sake. For example, a person who must take regular doses of an antibiotic medication (in pill form) throughout the day to combat an infection would find it convenient to carry the medication in the car, to work, and other places away from home. Recently, a pill form of insulin has been introduced allowing a diabetic person to take pills throughout the day to control the disease. Thus, it will be convenient, if not necessary, for such a person to carry these insulin pills with them at all times. Allergy sufferers also tend to carry antihistamine and decongestant medications with them where ever they go. In addition, efforts are under way to create a pill form of epinephrine which could be used by persons susceptible to incapacitating, even life threatening, allergic reactions. Clearly, if such pills becomes available, they will be carried with the user at a all times. These are just a few of many instances where persons who must take medication regularly during a day would find it advantageous to carry it with them.

Typically, those carrying medicine in the form of pills on their person simply keep these medications in their original containers. This practice, however, has drawbacks. The original containers, such as conventional plastic pill bottles, are bulky and are not easily carried in one's pockets. In addition, to gain access to the medicine, a person must first remove the cap of the container and then single out a pill for ingestion. This task can be very difficult if the person requiring the medicine has trembling or shaking hands or the container has a child-proof cap. There may also be a cotton plug inside the container which must be removed before gaining access to the medication. Additionally, the need for the medication may occur at night or while the victim is driving, or poor eyesight may make it particularly difficult for him or her to single out a pill for ingestion. Further, once the cap has been removed, the pills could be easily spilled and the user may not be able to find them in time to prevent harm, or alternately the medication could become contaminated and useless.

Sometimes, medication is transferred to small containers designed to allow a person to carry a few pills with them more conveniently than employing the original pill bottle. For example, nitroglycerin tablets are often carried in a small tube with an inside diameter just larger than the pills themselves. Usually five to seven pills are stacked one on top of another in this tube. Unfortunately, these containers are known to fail such as when the cap which seals the tube becomes cross-threaded and stuck thereby making it difficult to remove. The pills can also be crushed by the cap if too many are loaded within the dispenser, and if space is left to avoid this problem, vibration of the pills increases. Vibration has been known to powderize the nitroglycerin pills to the point where they become jammed within the tube and cannot be extracted. Additionally, when the pills become pulverized the dosage is then uncertain. Another problem with these tube dispensers is that like the larger containers, the pills stacked within the tube can be easily spilled. This is especially true when the user is incapacitated in some way. The dispenser is also difficult to load, especially for someone with poor sight or impaired dexterity, because the containers are very small. It is also often difficult to ascertain the number of pills in the container, or whether they are stacked properly.

Some of the same problems also manifest themselves in other commercially available pill containers. For example, so-called pill organizers are available. These organizers typically include multiple pill compartments each having a re-closeable hinged lid. One or more pills are placed into each compartment and the lid is closed. The lid is subsequently snapped open to gain access to the pill(s). Although such containers provide a convenient way to store and organize pills, they are not well suited for protecting the pills contained therein from the rigors of being carried around by the user. For instance, the person carrying the pills may be walking, running, or exercising, thereby subjecting the pills to shock and vibration as they bounce around inside the container. The resulting shock and vibration can cause the pills to break up or powderize. Nitroglycerin is especially susceptible to degradation due to shock and vibration. These pills are very soft, having a consistency similar to compacted powdered sugar, and are easily pulverized if allowed to bounce around inside a container.

In addition to vibration and shock, the above-described pill containers also do not adequately protect the pills from other environmental factors which can degrade the medication. Moisture, high humidity, high temperatures, and even light can degrade some medications. The aforementioned pill bottles and organizers are not designed to seal or insulate the pills within, and so the pills can be affected by the aforementioned environmental factors. It is easy to imagine that such conditions could be encountered as the pills are carried outdoors, through industrial processing areas, and the like by the user. Even the aforementioned specially designed pill containers do not provide complete protection. Although the pills may be sealed once they are closed within these specially designed containers, they must be placed into the container and removed therefrom for ingestion. The mere fact that the pills have to be handled can degrade some medications. For example, nitroglycerin can be adversely affected by the moisture on ones hands when they are handled during loading or unloading of the pill container.

Pills are sometimes packaged in so-called soft or blister packs. These packs typically have multiple compartments, each of which contains a single dose of medication which is sealed within the compartment. Thus, the pills are protected against moisture and high humidity conditions. An individual compartment can be opened exclusive of the rest to obtained access to the pill held inside. Typically, this involves peeling back a covering forming a part of the pill compartment or pushing the pill through a frangible wall of the compartment. A blister pack permits the handling of a single dose of medication at a time, and minimizes the risk of contamination of the remaining pills. In addition, these blister packs are pre-packaged by the pill manufacturer and so there is no handling required by the user to load the pills as with the aforementioned pill containers.

It is well known to place blister packs into pill dispensers which house the pack and allow the pills to be extracted. These dispensers often have devices to assist in extracting the pill from a compartment of the pack. Typically, this involves some sort of plunger which pushes on the top of the compartment so as to push the pill through a frangible bottom covering. However, heretofore the intent behind such dispensers has been simply to facilitate extraction of the pill, rather than to protect the pills from the environmental hazard that are encounter when someone carries the medication with them. In fact, these dispensers are typically designed so that the blister pack compartments could be seen by the user. This allows the user to see where the remaining pills reside. For example, such a visual access is an important feature of dispensers for some types of birth control pills. Blister packs containing these birth control pills actually contain a series of different pills which must be taken in a specific sequence over the course of a month. Thus, the dispensers are designed so that the user can see the pills so that they can be taken in order on the intended days. These dispensers often include markings which indicate the day and order in which the pills are to be taken.

As it is important to the current dispensers employing blister packs to allow visual access to the pills, they typically have openings through which at least the compartments containing the pills are exposed. In addition, these dispensers typically have openings adjacent the frangible bottom wall of the blister pack pill compartments through which the pill is extracted. Thus, even though the pills are sealed within the blister pack compartment, the compartments are susceptible to puncture or damage which would jeopardize the pill contained within. For example, if such a dispenser were to be carried with the user in a pocket or handbag, items such as pens, keys, and the like could puncture the blister pack compartments or push the pill hard enough to tear the frangible bottom covering. This would expose the pills to moisture and humidity. The open structure of these dispensers also provides no protection against the degrading effects of heat; and also light assuming the pill compartment has a transparent top covering which is typically the case. It is also noted that the blister packs are usually loosely supported within the dispensers and the pills themselves are often able to move within the blister pack compartment. Thus, potentially degrading levels of shock and vibration caused by the movements of the person carrying the dispenser could be transmitted to the pills.

Accordingly, there is a need for a pill dispenser which overcomes the problems associated with current pill containers and dispensers. This improved pill dispenser would be small and lightweight such that it can be conveniently carried with a person at all times. The dispenser would also protect each pill contained within the dispenser from the detrimental effects associated with it being carried on the user's person, such as by moisture, high humidity, high temperature, light, shock and vibration. Further, the dispenser would be easy to use even when the user is in an impaired state and would dispense individual doses of medicine without the user having to touch them.

SUMMARY

The above-described objectives are realized with embodiments of the present invention directed to an improved pill dispenser. A first embodiment of the pill dispenser includes a pill carrier having multiple through-holes forming pill chambers. Each of these pill chambers holds, at least initially, a pill which is sealed from the outside environment and completely contained within the pill chamber. The dispenser also has a housing with a pill carrier slot into which the pill carrier resides. There is also a pill dispensing channel forming a pathway from the slot to the exterior of the dispenser housing. In this embodiment of the pill dispenser, the pill carrier is displaceable within the slot. This allows each pill chamber to be sequentially aligned with the channel. A plunger apparatus is positioned adjacent the slot and opposite the channel. The plunger is capable of extending into a pill chamber then in alignment with the channel, so as to push a pill contained within the pill chamber into the channel for dispensing to the exterior of the housing. Thus, a user simply extends the plunger to release one of the pills from the dispenser.

The first embodiment of the pill dispenser additionally includes an indexing device which capable of displacing the pill carrier within the pill carrier slot. It is the indexing device which is used to sequentially align each pill chamber with the pill dispensing channel. The indexing device can take on many forms. For example, a detent mechanism with a series of stops can be employed. The user simply moves the detent from stop to stop. Each stop aligns one of the pill chambers with the plunger apparatus and the dispensing channel. Another version of the indexing device involves the use of a screw advance mechanism. In this version, the user rotates the back end of the dispenser to advance the pill carrier to the next pill chamber position. Another version of indexing device employs a click-stop mechanism reminiscent of a retractable ball point pen wherein a user clicks a button at the end of the dispenser and the pill carrier is advanced to the next pill chamber location.

The pill carrier can be configured in a variety of ways. In one version, the pill carrier has first and second sealing membranes covering the top and bottom of each pill chamber respectively. These sealing membranes seal a pill held with the pill chamber from the outside environment. In this version of the pill carrier, the pill chambers are sized so that they are just slightly larger than the cross-section of the pill when placed in its desired orientation within the pill magazine. For example, in the case of a disc-shaped pill which is to be placed flat within the magazine, the cross-section of the chamber would be just larger than the maximum diameter of the disc-shaped pill. In addition, the height of the pill chamber would be just slightly larger than the thickness of the pill. The intent to the aforementioned sizing is to allow enough room in the pill chamber such that the pill can be freely ejected without damaging the pill, while at the same time being tight enough to minimize any movement of the pill when the dispenser is subjected to shock and vibration during use. In another version of the pill carrier, a pill held within a pill sealing membranes sandwiched between two sealing membranes capable of sealing the pill from the outside environment. The pill is suspended by these membranes from the wall of the pill chamber to help mitigate the transference of vibration and shock to the pill. A third version of the pill carrier includes plungers disposed in an upper portion of each pill chamber. These plungers can be flush with or slightly recessed from the top surface of the pill carrier. The pills are disposed below the plunger and can be sealed in way similar to the first two versions of the pill carrier described above.

In all the aforementioned pill carrier configurations, the bottom sealing membrane can include a pattern of weakened areas designed to fail under a force from the pill. This allows the pill to pass through the bottom sealing membrane. Preferably, the force required to make the weakened areas fail is low enough to ensure the pill is not damaged during the dispensing process. The pattern of the weakened areas is also designed so that the portions of the sealing membrane adjacent the weakened areas remain attached to the membrane after the weakened areas have failed. This prevents pieces of the membrane from being torn free and dispensed with the pill.

It is further preferred that pill carrier is segmented such that each pill chamber is formed within a separate segment, and that the pill carrier segments are separable form each other. This allows the portion of the pill carrier containing expended pill chambers which would otherwise extend inconveniently out of the front of the pill dispenser housing to be snapped off and discarded.

A second embodiment of a pill dispenser constructed in accordance with the present invention includes a pill carrier similar to the first embodiment which resides in a slot formed within a dispenser housing. However, in this embodiment there are multiple pill dispensing channels forming individual pathways from the slot to the exterior of the dispenser housing, and multiple corresponding plungers. Each plunger is located adjacent the pill carrier slot and opposite a different one of the pill dispensing channels. In addition, the pill carrier is situated such that each of the pill chambers is in alignment with a different one of the plurality of pill dispensing channels. In this way, each plunger is capable of extending into a pill chamber which is in alignment with an associated channel so as to push a pill contained within the pill chamber into the channel for dispensing to the user. As there are multiple plungers in this second embodiment and the pill chambers are already in alignment with the plungers and dispensing channels, there is no need for an indexing mechanism. In addition, there is no need for the pill carrier to be segmented in any way.

The above-described pill dispenser embodiments have many advantages. They allow a patient to conveniently carry medication with them at all times, and have ready access to it. In addition, the dispenser uses sealed pill packs having individually sealed pills. In doing so, the medication is protected from the outside environment which could degrade it. The pill pack can also have a meaningful "use by" date. In the case where pills are removed from a factory sealed container and loaded into a pill dispensing device, the shelf life date is meaningless. For example, medication such as nitroglycerin tablets degrade rapidly even in the time it takes to transfer them from their factory sealed bottle to a pill dispenser. Thus, the true date at which the pills would become ineffective is unknown. In addition, the expiration date is on the original container, not the pill dispenser, and so can be easily forgotten.

As the pill dispenser is to be carried by a patient at all times, it is designed to be small and lightweight, ranging in size from a small unit perhaps 2 to 3 inches in length, which would be able to be carried on a necklace or keychain, up to a pen size unit. The size is mostly dictated by the size and number of pills to be carried. The dispenser is designed to dispense one pill at a time, while keeping the remaining supply of pills secure and protected within the body of the pill dispenser. In this way, the pills cannot be inadvertently spilled as is the case with currently existing pill dispensers on the market which do not dispense the pills one at a time. In addition, the medication is protected from the outside environment by the pill pack and dispenser. Thus, environmental factor such as moisture, high temperatures, light, and vibration will not effect the pills. Additionally, the materials making up the pill pack are chosen such that they do not react with the medicine. For example, the pill carrier, plungers, and dispenser housing can be made from Teflon, aluminum, Teflon coated aluminum, aluminum coated Teflon, or combinations of these material. In those cases where there is no risk of the medication reacting with the materials making up the dispenser, a transparent plastic might be employed so that the number of pill remaining can be readily ascertained by the user. The dispenser can also be colorized or color coded to designate the type of medication contained therein. For example, the housing could be colored or color coded. Alternately, the housing could be made of a transparent plastic and the pill carrier could be colored or color coded. Further, the color or color coding employed could be made to match that used by the pill manufacture on the pills themselves.

Most importantly, the dispenser is easily operated by the patient who may be older or incapacitated (such as by a heart patient having an attack of angina which requires the immediate ingestion of a nitroglycerin pill). It is also noted that the pill can be easily dispensed directly into the mouth of the patient without having to be handled. This precludes the possible contamination of the pill, for example by a patient having wet, dirty, or sweaty hands at the time the medication is to be taken. In addition, this has further advantage in that even if the pill has been fractured or powderized to some extent due to excessive vibration and shock, the entire dose is still ingested.

In addition to the just described benefits, other objectives and advantages of the present invention will become apparent from the detailed description which follows hereinafter when taken in conjunction with the drawing figures which accompany it.

DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

In the following description of the preferred embodiments of the present invention, reference is made to the accompanying drawings which form a part hereof, and in which is shown by way of illustration specific embodiments in which the invention may be practiced. It is understood that other embodiments may be utilized and structural changes may be made without departing from the scope of the present invention.

Figure 1A:
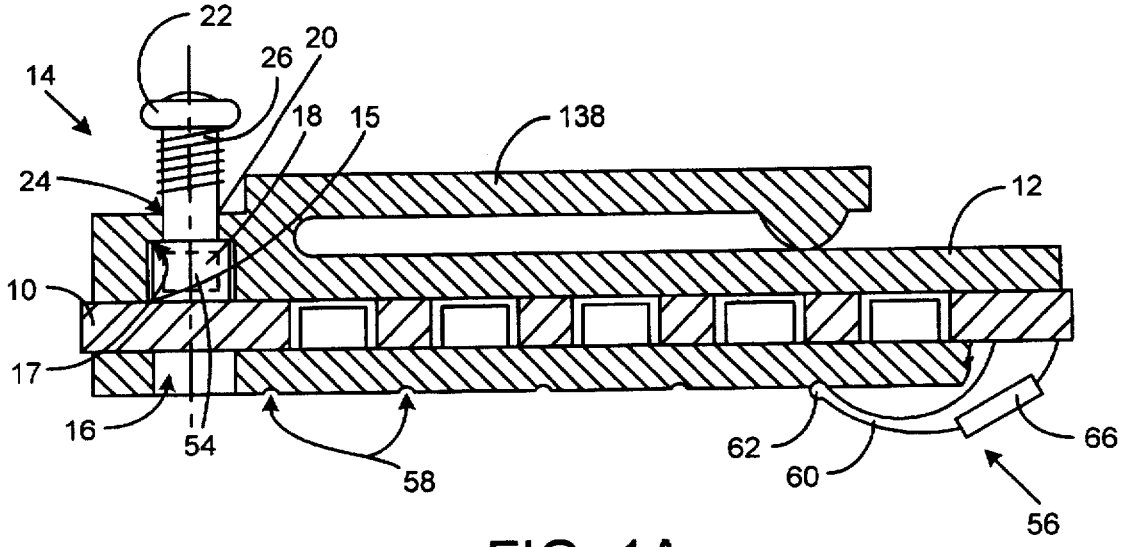
FIG. 1A is a cross-sectional side view of a first embodiment of a pill dispenser constructed in accordance with the present invention.
Figure 1B:
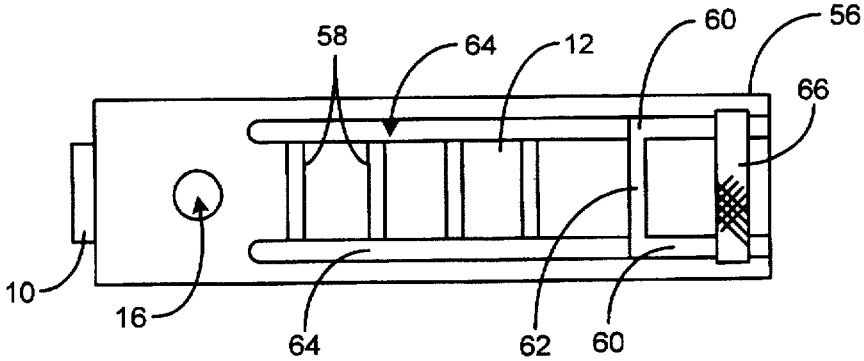
FIG. 1B is a bottom view of the pill dispenser of FIG. 1A.

FIGS. 1A–B depict a preferred embodiment of a pill dispenser in accordance with the present invention. In general, the pill dispenser has two main components, a pill carrier 10 and a dispenser housing 12. The housing 12 has an integral plunger 14 contained within a plunger chamber 15. The plunger 14 includes a punch head 18, a shaft 20 attached at one end to the punch head, a flange 22 attached to the other end of the shaft, and a biasing member. The punch head 18 is contained within the chamber 15 and has a maximum cross-sectional size which is slightly smaller than the cross-section of the chamber. Specifically, the cross-section of the punch head 18 is just smaller than that of the chamber 15 such that it can slide without appreciable resistance within the chamber. The shaft 20 extends upward from the backside of the punch head 18 through a hole 24 located at the top end of the chamber 15. This hole 24 has a cross-section which is slightly larger than that of the shaft 20 so as to facilitate the shaft sliding within the hole. However, the cross-section of the hole 24 is smaller than the cross-section of the chamber 15 such that a shoulder 17 is formed at the top end of the chamber. This shoulder 17 stops the upward movement of the plunger 14. The shaft 20 terminates at its distal end with the flange 22 which has a cross-sectional size larger than that of the shaft 20. The biasing member, which is depicted as a compression spring 26 in FIG. 1, surrounds the portion of the shaft 20 extending from the dispenser housing 12. The ends of the spring 26 abut the underside of the flange 22 and the exterior surface of the housing 12, respectively. This spring 26 biases the punch head 18 into a retracted position adjacent the top end of the chamber 15, as shown in FIG. 1.

Figure 2A:
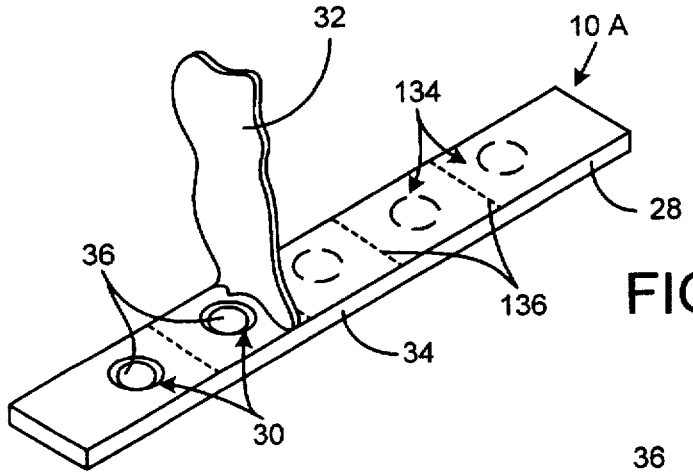
FIG. 2A is a perspective view of one embodiment of a pill carrier constructed in accordance with present invention.
Figure 3:
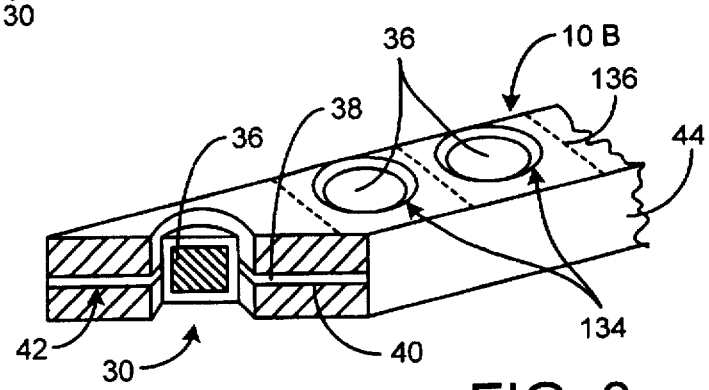
FIG. 3 is a partially cut-away perspective view of a portion of another embodiment of a pill carrier constructed in accordance with present invention.
Figure 2B:
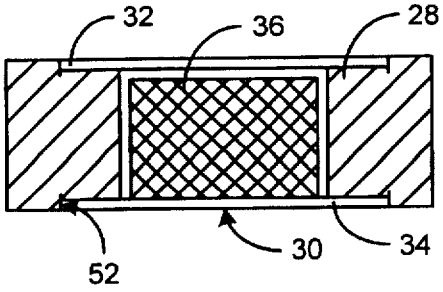
FIG. 2B is a lateral cross-sectional view of the pill carrier of FIG. 2A.

The pill carrier 10 is designed to slide longitudinally within the housing 12. The pill carrier can take many forms, two preferred embodiments of which are depicted in FIGS. 2A–B and 3. FIGS. 2A–B depict a pill carrier 10*a* generally constructed of a pill magazine 28 with through-holes forming pill chambers 30 spaced along the length thereof. Upper and lower sealing membranes 32, 34, respectively cover the top and bottom surfaces of the magazine 28, thereby sealing a single pill 36 within each pill chamber 30. It is noted that the membranes 32, 34 need not cover the entire top and bottom surfaces of the magazine 28 as shown in FIG. 2A, but could alternately just cover the pill chambers 30 and some small portion of the magazine surface surrounding the pill chambers. The membranes 32, 34 are attached to the surface of the magazine 28 by any appropriate conventional means which would result in the pills 36 being sealed within the pill chambers 30. For example, this could involve an adhesive disposed between the bottom of the membrane and the adjacent surface of the magazine. No adhesive is placed on those portions of the membranes overlying the pill chamber so as to prevent adhesion of any portion of a membrane to a pill.

The pill chambers 30 are sized so that they are just slightly larger than the cross-section of the pill 36 when the pill is placed in its desired orientation within the pill magazine 28. For example, in the case of a disc-shaped pill 36 which is to be placed flat within the magazine 28, the cross-section of the pill chamber 30 would be just larger than the maximum diameter of the disc-shaped pill. In addition, the height of the pill chamber 30 would be just slightly larger than the thickness of the pill 36. The intent of the aforementioned sizing is to allow enough room in the pill chamber 30 such that the pill 36 can be freely ejected without damaging the pill (as will be described later in this description), while at the same time being tight enough to minimize any movement of the pill when the dispenser is subjected to shock and vibration during use. As explained previously, excessive shock or vibration transferred to the pill 36 can fracture or pulverize it.

Of course, the pill chambers can be similarly sized and shaped to accommodate other shapes and orientation of the medication. For example, the chambers would have an oblong cross-sectional shape to accommodate a capsule in a flat orientation, or a circular cross-section to accommodate a capsule place on end within the magazine. Similarly, the chamber might have a rectangular slot-shaped cross-section if a disc shaped pill where placed on end in the magazine.

Figure 4:
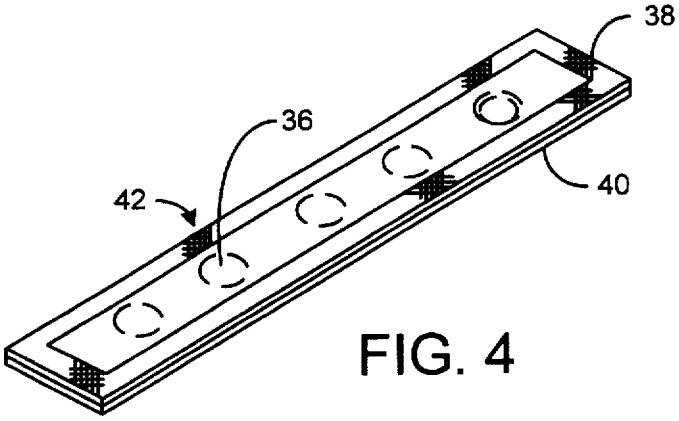
FIG. 4 is a perspective view of a pill pack for use with the pill carrier of FIG. 3.

FIG. 3 depicts a second preferred embodiment of a pill carrier 10*b*. In this embodiment, the pills 36 are sandwiched between two membrane strips 38, 40 and spaced apart along the length of the resulting pill pack 42, as best shown in FIG. 4. FIG. 3 shows the pill pack 42 incorporated into a pill magazine 44. The pill magazine 44 is similar to that described in connection with FIG. 2A in that it includes pill chambers 30 spaced along the length thereof. However, in this case the aforementioned pill pack 42 is sandwiched between upper and lower sections of the magazine 44, with the encased pills 36 being centered within the pill chambers 30. The pill chambers 30 have a cross-sectional areas which are larger than that of the encased pills 36 so as to suspend the pills by the encasing membranes 38, 40 from the side wall of the pill chambers. This suspension of the pills 36 acts to dampen the transference of shock and vibration from the dispenser to the pills. In this embodiment, the two sections of the pill magazine 44 can be permanently affixed to each other or even integrally formed around the pill pack 42. This would result in a disposable pill carrier 10*b* which would be replaced once all or some of the pills 36 are expended. Alternately, the two halves of the magazine could include interfacing structures which would releasable lock the sections together. Thus, when some or all of the pills have been expended, the sections could be separated, a new pill pack inserted, and then locked back together. Thus, a refillable pill carrier is created. The interfacing structures employed can be any conventional type appropriate for the task. As such structures are well known and do not form a novel part of the present invention, no further description will be provided herein.

FIG. 3 depicts a pill pack 42 and pill magazine 44 designed for disk shaped pills oriented in a flat position. However, as with the first preferred embodiment of the pill carrier, the pill chambers of the second embodiment can be sized and shaped to accommodate other shapes and orientation of the medication.

Figure 5A:
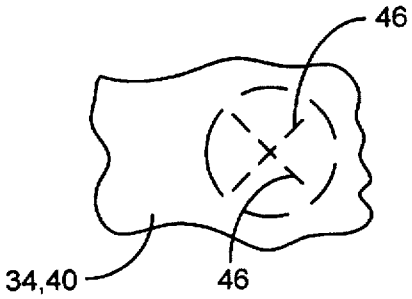
FIG. 5A is a partial view of a bottom sealing membrane of a pill carrier showing one version of a frangible pattern in the portion of the membrane underlying a pill.
Figure 5B:
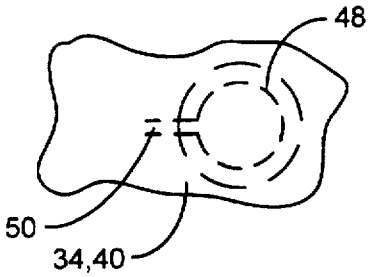
FIG. 5B is a partial view of a bottom sealing membrane of a pill carrier showing another version of a frangible pattern in the portion of the membrane underlying a pill.

The lower membrane 34, 40 of either the pill carrier embodiments of FIGS. 2A–B or FIG. 3 is also preferably weakened, such as by scoring, in a certain pattern where it underlies a pill chamber 30. This facilitates pushing the pill through the bottom membrane 34, 40 to extract it from the chamber 30 as the weakened areas are designed to rupture when relatively little force is applied. Specifically, the weakened areas are designed to rupture under a force which is less than that which would fracture or crush the pill 36 being pushed against the lower membrane 34, 40. These weaken areas also dictate the pattern of the rupture. It is preferred that this pattern be such that an opening large enough to pass the pill 36 therethrough is created, but that the torn sections of the membrane 34, 40 remain attached. In this way, pieces of the membrane 34, 40 are not ejected from the dispenser with the pill 36, and so can not be inadvertently ingested when a pill is dispensed directly into the mouth of the user. FIGS. 5A and 5B illustrate two possible patterns which can be employed. FIG. 5A depicts weakened areas 46 forming the shape of the letter "X" across the portion of the membrane 34, 40 underlying the pill. When the pill is pushed through, the membrane 34, 40 ruptures along the weakened areas 46 forming triangular pieces which remain attached to the rest of the membrane. FIG. 5B shows an alternate pattern where the weakened areas 48 form an incomplete circle. In this case, when the pill is pushed through, the membrane 34, 40 ruptures along the weakened areas 48 but the resulting circular piece remains attached to the rest of the membrane by the tab 50.

Referring once again to FIGS. 2A–B, it is noted that the bottom surface of the pill magazine 28 to which the lower membrane 34 is attached, is recessed slightly. The recess 52 forms a small space between the pill carrier 10*a* and the adjacent interior surface of the dispenser housing when the carrier is installed in the housing. This space accommodates the ruptured sections of the lower membrane 34 once the pill 36 has been ejected so that they are not torn free as the pill carrier 10*a* is translated through the dispenser housing. Accordingly, the recess 52 need only be slightly deeper than the thickness of the lower membrane 34. It is also noted that no recess is required in the embodiment of the pill carrier 10*b* depicted in FIG. 3, as there is already adequate room to accommodate the ruptured pieces of the membranes 38, 40 within the lower portion of the pill chamber 30.

Referring again to FIG. 1, in operation, pill chambers 30 are lined up with the dispenser channel 16 of the housing (as will be explained in detail later in this description). Once a pill chamber 30 is lined up with the channel 16, all the user need do is press down on the flange 22 of the plunger device. In the case of a pill carrier 10*a* such as described in connection with FIGS. 2A–B, the punch head 18 is forced through the upper membrane 32 overlying the pill chamber 30 and thereafter pushes the pill 36 through the lower membrane where it falls out of the open end of the dispenser channel 16 and into the mouth or hand of the user. In the case of a pill carrier 10*b* such as described in connection with FIG. 3, the punch head 18 pushes against the upper membrane strip 38 and the underlying pill 36, thereby rupturing the weakened area in the lower membrane 40. The pill 36 then falls out the open end of the dispenser channel 16.

The length of the shaft 20 is just long enough to ensure the pill 36 is completely pushed free of the lower membrane 34, 40. As the pill 36 itself is used to rupture the bottom membrane 34, 40, the punch head 18 does not have to extend past the lower membrane in order to accomplish the task of ejecting the pill. Limiting the travel of the punch head 18 to just above the lower membrane 34, 40 is in fact preferred as this ensures the punch head will not tear the ruptured pieces of the lower membrane free.

FIG. 1A shows the punch head 18 as having an angled face 54. The angled face 54 initially contacts only a small area of the upper membrane 32, 38 overlying the edge of the pill chamber 30, and then progressively contacts more and more of the membrane as the punch head moves down through the pill chamber. This angled face 54 facilitates a smooth penetration of the upper membrane 32, 38 by the punch head 18 and is particularly useful for soft pills such as nitroglycerin. However, if the pills are hard, the face of the punch head can be flat as it is unlikely the plunger will damage the pill before it is pushed through the lower membrane of the pill carrier. The face of the punch head could also be curved so as to have a cross-section which forms a part of a circle. This curved punch head would be useful in dispensing capsules which are oriented on edge in the pill carrier; especially soft capsules such as so-called gel-caps. It is also noted that a projection of the cross-sectional shape of the punch head 18 is made to correspond to the cross-sectional shape of the pill chamber 30 (e.g. round, oblong, rectangular, etc.). In addition, the overall size of the projected cross-sectional shape of the punch head 18 is preferably (with one exception as will be described later) just slightly smaller than the cross-sectional shape of the pill chamber 30.

The dispenser further includes a mechanism for indexing the pill carrier 10 in relation to the dispenser housing 12. This mechanism is used to advance the pill carrier 10 until one of its pill chambers 30 lines up with the channel 16 of the housing. Many different structures could be employed to accomplish this task. For instance, the indexing mechanism could take the form of a detent mechanism, a screw advance mechanism, or a click advance mechanism. Examples of preferred versions of these indexing mechanisms are shown in FIGS. 1A–B, 6 and 7, respectively. However, it is not intended to limit the present invention to the specific examples shown in these figures. Rather, any appropriate mechanism could be employed as long as it provided a means for the user to advance the pill carrier in relation to the dispenser housing so as to sequentially align each pill chamber with the plunger device and dispenser channel.

The embodiment depicted in FIG. 1A–B illustrates one version of a detent mechanism capable of accomplishing the aforementioned objective. In this case, the detent 56 is made part of the pill carrier 10 and the associated indexing stops 58 are formed in the bottom of the dispenser housing 12. The detent 56 is attached aft of the last pill chamber 30 and includes two curved fingers 60 extend away from the carrier 10 and cantilevered over the bottom of the dispenser housing 12. The distal ends of the fingers 60 are connected together by a crossmember 62 which has a cylindrical shape designed to interface with the stops 58. The stops 58 are laterally oriented grooves having a semi-circular cross-section. The fingers 60 of the detent bias the crossmember 62 against the bottom of the housing 12, or into one of the stops 58, depending on the position of the pill carrier 10 in relation to the housing. The stops 58 are spaced periodically along the length of the bottom of the housing 12 at locations which when the crossmember 62 of the detent is held within a stop, a pill chamber 30 of the carrier is aligned with the dispenser channel 16. Accordingly, there is one stop 58 for every pill chamber 30. The portion of the fingers 60 adjacent the pill carrier 10 slide within longitudinal slots 64 formed in the bottom of the dispenser housing 12. These slots 64 (and so the fingers 60) are spaced apart so as to not overlie the pill chambers 30. Thus, the pill chambers 30 remain covered and protected by the dispenser housing 12 until aligned with the dispenser channel 16 for dispensing of a pill 36. Preferably, there is also a grip pad 66 connected between the fingers 60 at a point which allows the pad to just clear the bottom of the housing 12 when the fingers are fully engaged in the housing slots 58. This grip pad 66 provides a convenient surface for the user to press against to move the pill carrier 10 through the housing 12. In addition, pressure on the pad 66 tends to lift the crossmember 62 out of a stop 58 because of the curved shape of the fingers 60, thereby making it easier for the user to move the pill carrier 10 from one stop to the next. The grip pad 66 may also have a textured surface so as to as to help prevent the user's finger or thumb from slipping when pushing on the pad.

Figure 6A:
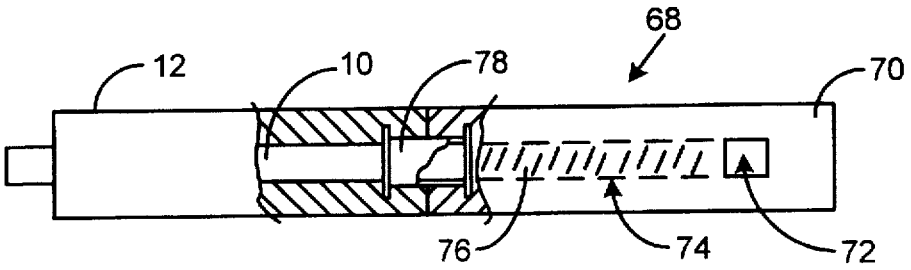
FIG. 6A is a partially cross-sectional side view of a pill dispenser constructed in accordance with the present invention employing a screw advance indexing mechanism.
Figure 6B:
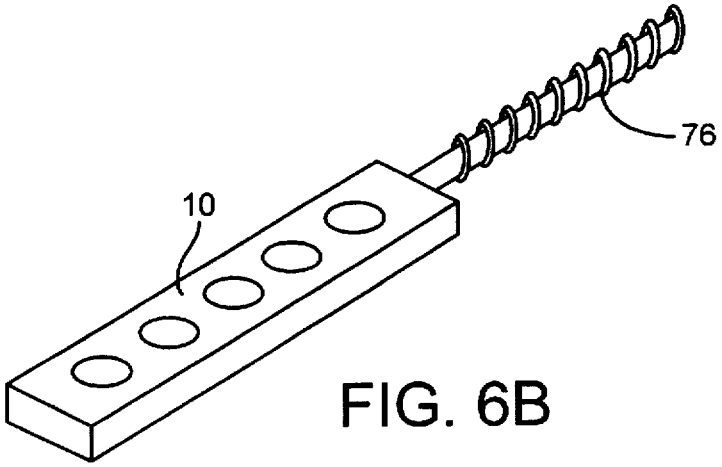
FIG. 6B is a pill carrier with a screw advance rod attached to its aft end as employed in the pill dispenser of FIG. 6A.

An alternate embodiment for moving the pill carrier 10 in relation to the dispenser housing 12 is depicted in FIG. 6A–B. In this embodiment, a screw advance section 68 is added to the aft end of the housing 12. The screw advance section 68 includes a rotatable housing 70 preferably having the same cross-sectional dimensions as the dispenser housing 12. The rotatable housing 70 has a centrally located longitudinal bore 72 which is threaded. These threads 74 mate with the threads of a screw advance rod 76. The rod 76 is attached to the aft end of the pill carrier 10. A slip sleeve 78 is used to connect the dispenser housing 12 to the rotatable housing 70, but still allows the rotatable housing to be rotated in relation to the dispenser housing. The threads 74 are designed such that when the rotatable housing 70 is rotated a prescribed amount, the screw advance rod 76 will move forward and push the pill carrier 10 the distance necessary to align a pill chamber with the housing's dispenser channel. Each subsequent rotation of the same amount and in the same direction advances the next pill chamber into alignment with the channel. The pill dispenser also preferably has indicia (not shown) which can be used to determine when the rotatable housing 70 has been rotated the required amount for the ejection of the next pill.

Figure 7:
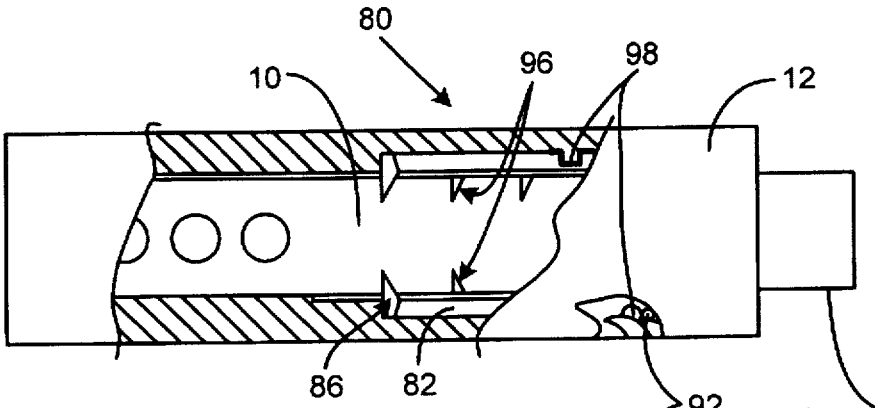
FIG. 7 is a partially cross-sectional top view of a pill dispenser constructed in accordance with the present invention employing a click advance indexing mechanism.
Figure 8:
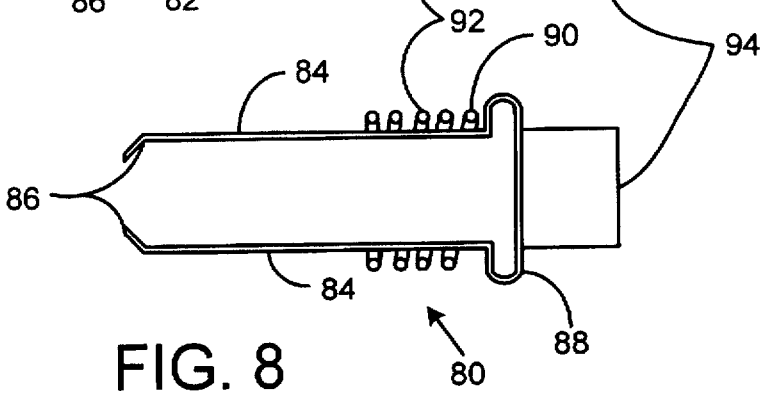
FIG. 8 is a partially cross-sectional view of a part of the click advance mechanism employed in the pill dispenser of FIG. 7.

Yet another embodiment for moving the pill carrier in relation to the dispenser housing is depicted in FIG. 7 and 8. This embodiment employs a click advance mechanism 80. The click advance mechanism 80 resides in a widened portion 82 of the pill carrier cavity of the dispenser housing located at its aft end. As best shown in FIG. 8, the mechanism 80 includes two longitudinally oriented advancing tines 84. These tines 84 have inwardly angled catches 86 at their distal ends and are connected to a flange 88 at their other ends. The flange 88 has a rectangular shape and extends past the connection point of the tines 84 in the lateral direction, thereby forming shoulders 90 on each side of the tines. A rectangular-shaped compression spring 92 fits over the tines 84 and abuts on one end against the shoulders 90. An advancing button 94 is attached to the side of the flange 88 opposite the tines 84 and spring 92, and has a width (lateral direction) somewhat less than that of the flange. Referring to FIG. 7, it can be seen that the advancing button 94 extends from the back end of the dispenser housing 12 through a hole therein when the advancing mechanism is in its retracted position (as shown). In addition, the pill carrier 10 includes pairs of triangular-shaped indentations 96 disposed on each side carrier 10. The individual indentation pairs are spaced apart along the length of the carrier 10 and are formed such that each indentation 96 has a laterally-oriented wall at its end closest to the front of the dispenser. The catches 86 at the ends of the tines fit into these indentations 96 and push against the forward walls of a pair indentations when the advancing button 94 is depressed by a user. This advances the pill carrier 10 forward in the dispenser housing 12. The indentations 96 are placed such that when the advancing button 94 is fully depressed by the user, the carrier 10 advances a sufficient amount to align one of the pill chambers with the dispenser's plunger mechanism. The forward end of the spring 92 abuts a pair of projections 98 extending into the pill carrier cavity from its side walls. Thus, when the user depresses the advancing button 94, the spring 92 is compressed between the flange 88 of the advancing mechanism and the aforementioned pill carrier cavity projections 98. When the user releases the advancing button 94, the compressed spring 92 forces the advancing mechanism 80 backwards such that the flange 88 abuts the end of the pill carrier cavity and the advancing button 94 once again extends from the end of the housing 12. This also causes catches 86 at the end of the tines to slide back over the sides of the pill carrier 10 and into a next pair of indentations 96. The advancing mechanism 80 is then in position to index the pill carrier 10 to the next pill location.

Figure 9B:
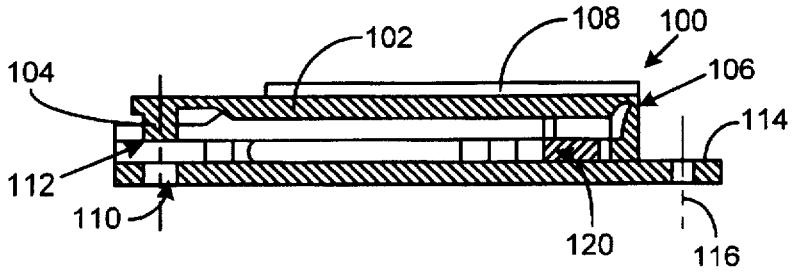
FIG. 9B is a cross-sectional side view of the pill dispenser of FIG. 9A.
Figure 9C:
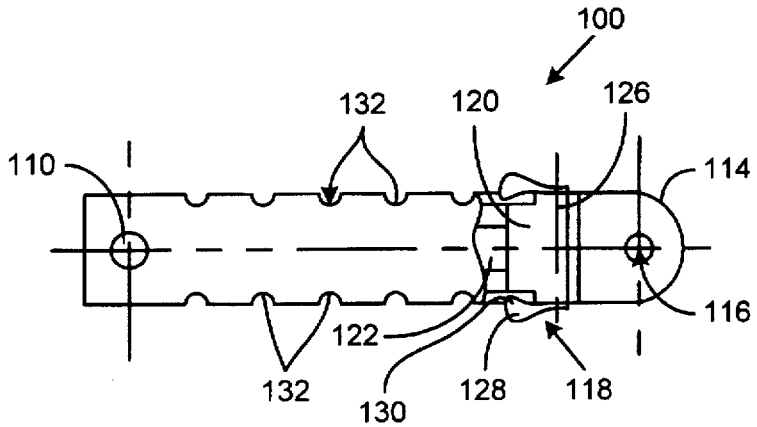
FIG. 9C is a partially cut-away bottom view of the pill dispenser of FIG. 9A.
Figure 9A:
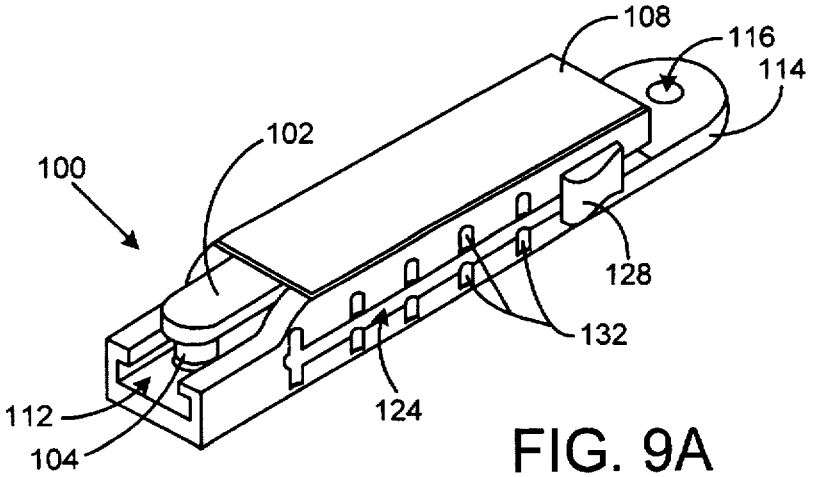
FIG. 9A is a perspective view of a second embodiment of a pill dispenser (less pill carrier) constructed in accordance with the present invention.

FIGS. 9A–C depict a second preferred version of a dispenser housing 100 in accordance with the present invention. In this version, the plunger (of FIG. 1) has been replaced with a cantilevered arm 102 which is hinged at the aft end of the housing 100 and which has a punch head 104 affixed to the distal end of the arm. The punch head 104 is preferably of the same configuration as that described in conjunction with the embodiment of FIGS. 1A–B. The dispenser housing 100 can be made of a variety of materials, as will be described in detail later in this description. However, when the housing 100 is made from a resilient plastic material, the aforementioned hinge at the aft end of the arm 102 is preferably a living hinge 106, as best shown in the cross-sectional view of FIG. 9B. A plate 108 attached to the top surfaces of the sides of the dispenser housing 100 covers the arm 102 for most of its length. Only a portion of the distal end of the arm 102 extends past the covering plate 108. The arm 102 is biased upward against the plate 108 by the living hinge 106 into a retracted position. In this retracted position, the punch head 104 is held above any portion of a pill carrier lying thereunder. The pill carrier employed in this embodiment is preferably the same as those described previously in conjunction with FIGS. 2A–B and 3. A user presses on the top of the exposed portion of the arm 102 to force the punch head 104 into a pill cavity of the pill carrier in order to dispense a pill. The pill falls through the dispenser channel 110 underlying the punch head 104 and into the user's mouth or hand. The sides of the housing 100 at its forward end are reduced in height so as to facilitate the user depressing the distal end of the cantilevered arm 102. The arm 102, in conjunction with the bottom and sides of the housing 100 define a rectangular cavity 112 in which the pill carrier is installed. A wall closes the back end of the housing 100, but the front end of the housing is open to allow the pill carrier to slide forward within the cavity 112. There is also preferably a tang 114 which extends from the back wall of the housing 100. This tang 114 has a through-hole 116 which accommodates a ring, chain, or the like.

Figure 10:
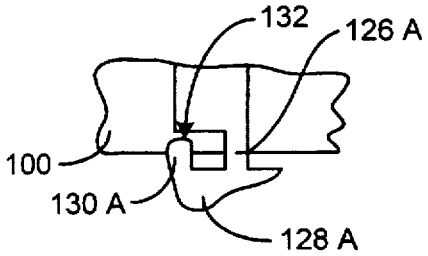
FIG. 10 is a partial, cut-away view of an alternate detent mechanism constructed in accordance with the present invention.

The dispenser also includes a variation of the detent mechanism shown in FIG. 1 for indexing the pill carrier, as best shown in the partially cut-away bottom view of FIG. 9C. In this case, the detent mechanism 118 is separate from the pill carrier. Specifically, it includes a push bar 120 which extend laterally within cavity 112 behind the pill carrier 122. This bar 120 abut the aft end of the pill carrier 122 and is used to push it forward. To this end, a longitudinal slot 124 (see FIG. 9A) is formed in each side of the housing 100. A part of the aft portion of the push bar 120 extend through the slot 124 on each side. These extensions 126 are each connected to a tab 128 which abuts the exterior surface of the corresponding side of the housing 100. The tabs 128 are preferably shaped with a thicker forward portion so as to facilitate a user placing his or her fingers on the tabs on either side of the housing 100 and sliding the tabs forward, thereby pushing the pill carrier 122 forward as well. In addition, the outer surface of the tabs 128 can be textured to improve the user's grip even further. Each tab 128 also has a semi-circular protrusion 130 extending from the side of the tab abutting the housing 100. This protrusion 130 extends from the forward portion of the tab 128 which cantilevers away from the push bar extension 126. In addition, the protrusion 130 preferably runs from the bottom to the top of the tab 128 adjacent the forward end of the tab. Indexing stops 132 are formed in the sides of the dispenser housing 100. The stops 132 are vertically oriented grooves having a semi-circular cross-section. Each stop 132 includes a top portion formed above the slot 124 and a bottom portion formed below the slot. The stops 132 on either side of the housing 100 are aligned in the longitudinal direction and are sized so that they capture the tab protrusions 130. Further, the stops 132 are spaced periodically along the length of the bottom of the housing 100 at locations which when the protrusions 130 of the tabs are held within a stop 132, a pill chamber of the carrier 122 is aligned with the dispenser channel 110. Consequently, there is one stop 132 for every pill chamber. In operation, the user pushes the tabs 128 forward sliding the protrusions 130 over the exterior surface of the housing 100 and causing the bar 120 to push the pill carrier 122 forward until the protrusions fall into the next stop 132. The tabs 128 and extensions 126 of the push bar are made of materials and interconnected so that the protrusions 130 are biased against the sides of the housing 100. This ensures the protrusion 130 will fall into a stop 132 when encountered. However, this bias is no so strong as to cause difficulty for the user to disengage the protrusions 130 from a stop 132. The tabs and extensions could also be modified to further facilitate the disengagement of the protrusions from the stops. As shown in FIG. 10, this modified detent mechanism includes extensions 126*a* which extend slightly away from the exterior side of the housing 100. Each tab 128*a* is connected to the extension 126*a* in its middle thereby cantilevering the forward portion and the aft portion of the tab 128*a*. In addition, the protrusion 130*a* on the forward portion of the tab 128*a* abuts and is biased against the exterior surface of the housing 100. The extension 126*a* and tab 128*a* are made of a resiliently flexible material. In operation, the user squeezes on the back portion of the tabs 128*a* on either side of the housing 100 to disengage the protrusions 130*a* from the stops 132. This squeezing rotates the protrusions 130*a* out of the stops 132. The user then pushes the tabs 128*a* forward as described previously. Although the foregoing version of the detent mechanism is describe in reference to the embodiment of the dispenser depicted in FIGS. 9A–C and 10, it could also be employed with the embodiment of FIGS. 1A–8, if desired in lieu of the previously described indexing configurations.

It is evident from the foregoing descriptions of the various embodiments of the present invention that the pill carrier would extend from the front end of the dispenser housing after the first (i.e. forwardmost) or second pill has been dispensed. Although, this could be acceptable, it is preferred that the pill carrier not extend in this manner so as to make the pill dispenser as short and as non-obtrusive to the user as possible, no matter which pill is the next to be dispensed. This objective can be realized by segmenting the pill carrier into detachable or breakable sections 134, as shown in FIGS. 2A and 3. Each section 134 includes one pill chamber 30. The sections 134 are divided by an area made susceptible to failure under a bending moment. For example, as shown in FIGS. 2A and 3, this weakened area could take the form of a laterally oriented line of vertical perforations 136 located between each pill chamber 30. The material making up the pill magazine 28 is chosen to be brittle so that it break along the perforations 136 when a reasonable amount of bending force is applied. Specifically, the amount of force required would preferably be that which even a weak or elderly user could apply in operation, a user would dispense the first pill 36 in the carrier by indexing the first pill chamber 30 into alignment with the dispenser channel. Ideally, the portion of the carrier 10*a*, 10*b* forward of the first pill chamber 30 extends just far enough to be flush with or only slightly protruding from the front end of the dispenser housing when the first pill chamber is in the aforementioned alignment. Thus, the pill carrier 10*a*, 10*b* does not obtrusively protrude and the dispenser does not effectively increase in length. The user next indexes the pill carrier 10*a*, 10*b* to align the second pill chamber 30 with the dispenser channel. This causes the section 134 of the pill carrier containing the first pill chamber 30 to extend from the front end of the housing. The previously described line of perforations 136 dividing the first and second sections 134 of the pill carrier is located so as to align with the front end of the dispenser housing or just slightly outside the housing's front end. Either after or before dispensing the second pill 36, the user grasps the extending first section 134 of the pill carrier and the dispenser housing, and bends the first section in relation to the housing until the first section breaks free. The first section 134 is then discarded. Here again, the pill carrier 10*a*, 10*b* does not extend appreciably out of the housing and so the desired length of the dispenser is maintained. This process is repeated for each succeeding pill carrier section 134, excluding the last.

It is noted that even though the weaken area separating the pill carrier sections is depicted in FIGS. 2A and 3 as including perforations, this need not be the case. Any appropriate method of creating an area which will readily detach one section from an adjacent section can be employed. For example, the thickness of the material in the weakened area could be reduced to ensure the pill carrier sections break away from each other when bent. In another example, the interfacing edges of adjoining sections could include structures which releasably attach the section together. In such a case, the user would simply apply the appropriate force to cause the attaching structures to detach, thereby freeing a section from the rest.

Figure 11:
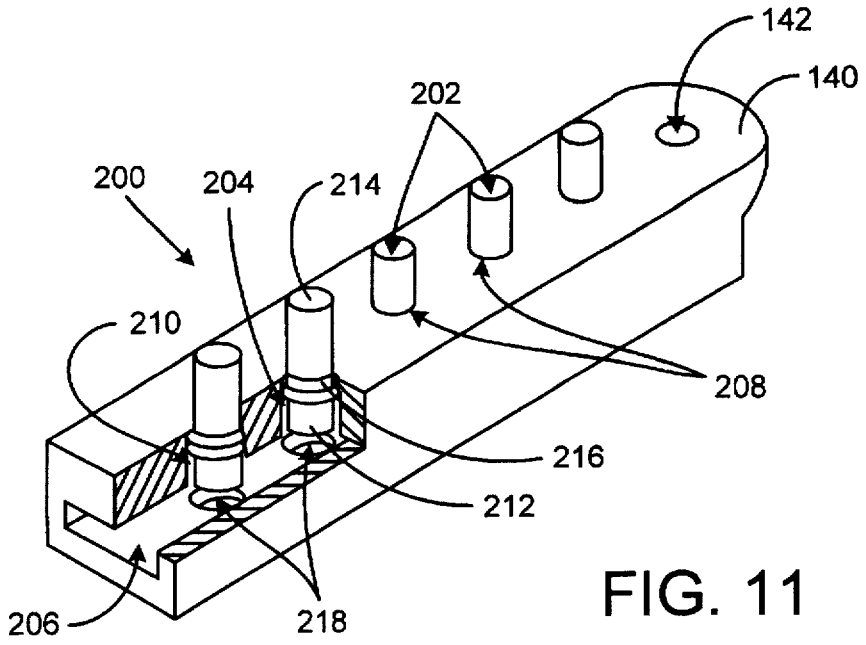
FIG. 11 is a partially cut-away perspective view of a third embodiment of a pill dispenser (less pill carrier) constructed in accordance with the present invention.

FIG. 11 depicts yet another version of a pill dispenser housing 200 constructed in accordance with the present invention. In this version of the housing 200, there is no need for a pill carrier advancement mechanism such as those described previously. Neither is there a need to employ the aforementioned segmented pill carrier, although such a carrier could be employed without impact if desired. These simplifications are possible because, this version of the dispenser housing 200 employs a system of multiple plungers 202. Specifically, there is a separate plunger 202 for each pill chamber in the pill carrier. Each plunger 202 resides in a plunger chamber 204 formed in the upper portion of the dispenser housing 200. This chamber 204 has a cross-sectional size (e.g. in the depicted case it is a particular diameter) which is the same from the point where the plunger chamber opens into a longitudinal pill carrier slot 206 of the housing to a point close to the top surface of the upper portion of the housing 200. A plunger hole 208 having a smaller cross-sectional size (e.g. diameter) than the plunger chamber 204 extends from the top end of the plunger chamber and opens out to the exterior of the housing 200. Thus, a shoulder 210 is formed at the top of the plunger chamber 204. Each plunger 202 has a lower punch head section 212, a upper actuator section 214, and an intervening flange section 216 separating the upper and lower sections. The punch head section 212 of the plunger is used to push a pill from its pill chamber in the pill carrier and out an dispenser opening 218 extending through the lower part of the housing. Accordingly, there is such an opening 218 directly opposite each plunger 202 in the housing 200. The length of the punch head section 212 and the shape of its punch face are similar to that of the plungers described previously in connection with the embodiments depicted in FIGS. 1A–B and 9A–C. In addition, like the previous embodiments, the cross-sectional size of the punch head section 212 is made to be just slightly smaller than that of the pill chamber in the pill carrier. The flange portion 216 has a cross-sectional size, (i.e. in the case of FIG. 11 a diameter) which creates a slight jam fit in the plunger chamber 204. Specifically, it is preferred that the interference between the periphery of the flange portion 216 and the wall of the plunger chamber 204 be light enough such that the plunger 202 can be pushed down into the housing 200 using a reasonable amount of finger pressure by the user, but tight enough that the plunger 202 will not move within the chamber 204 absent the downward force of the user's finger on the actuator section 214 of the plunger. The flange section 216 also has other functions. When the plunger 202 is in its retracted position, such as shown in FIG. 11, it abuts the shoulder 210 at the top of the plunger chamber 204, thereby holding the plunger within the chamber and in the retracted position. When the plunger 202 is depressed by the user to dispense a pill, the flange section 216 limits the travel of the punch head section 212 into the pill chamber by coming into contact with the upper surface of the pill carrier surrounding the pill chamber. Thus, the punch head section 212 does not over-extend into the pill chamber. The actuator section 214 extends from the flange section 216 up through the plunger hole 208 and to a point above the hole. The length of the actuator section 214 extending above the plunger hole 208 is preferably just enough so that when pushed down flush with or slightly above the exterior side of the hole, the punch head 212 penetrates the pill chamber the desired amount and the flange section 216 is brought into contact with the upper surface of the pill carrier. It is noted that the slight jam fit of the flange section 216 with the plunger chamber 204 will cause the plunger 202 to remain in its actuated position, thereby indicating to the user that the pill corresponding to that plunger has been previously dispensed. Thus, the user can quickly and easily determine which pills are still available and how many have been dispensed. The pill carrier slot 206 is designed to retain a pill carrier placed within and to facilitate the alignment of the pill chambers with the plurality of plungers 202. To this end, the slot 206 is made to have a slight jam fit with the pill carrier so that once installed it does not easily move. Preferably, this jam fit is in the lateral direction so that no appreciable pressure is placed on the top or bottom of the pill carrier during installation, as this may damage the sealing membranes on some pill carriers (e.g. the embodiment of FIG. 2). Further, the pill carrier slot 206 is closed at its back end and made just long enough such that when the pill carrier is abutted against this back end of the slot, all the pill chambers line up with the plungers 202 and dispenser openings 218. It is also preferred that the portion of the dispenser housing 200 forward of the first plunger 202 be long enough so that the end of the pill carrier can be made flush with the open end of the pill carrier slot 206 when it is fully inserted and abutting the back end of the slot. In this way, the user will know positively that the pill carrier is installed correctly and that the pill chambers are aligned with the plungers 202 and openings 218. The cross-sectional shape of the plunger punch head section 212 would conform to the shape of the cross-section of the pill chambers in the same way the cross-sectional shape of the previously-described dispenser punch head (of FIGS. 1A–B and 9A–C) conform to that of the pill chamber. Therefore, pills having different shapes and orientations in the pill carrier can be accommodated.

Figure 12:
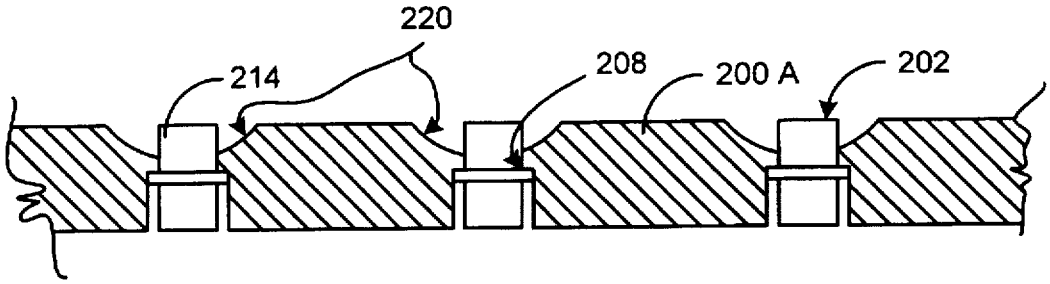
FIG. 12 is a partial, cross-sectional side view of the pill dispenser of FIG. 11.

The embodiment depicted in FIG. 11 can be advantageously modified by including a series of depressions 220 in the upper surface of the dispenser housing 200*a*, each of which terminates at one of the aforementioned plunger holes 208, as shown in FIG. 12. The depressions 220 are deep enough such that top end of the actuator section 214 of each plunger 202 lies below the top surface of the associated depression. Preferably, the depressions 220 are also wide enough such that the user can still fully depress the plunger 202 using his or her finger without significant interference. The purpose of the depressions 220 is to recess the actuator section 214 of the plunger somewhat below the exterior surface of the housing 200 so as to provide a certain amount of protection from inadvertent actuation of the plunger 202. For example, the use of the depressions 220 makes it unlikely that a plunger 202 would be activated by a user when depressing an adjacent plunger to dispense a pill, even where the plungers are close together.

The dispensers constructed in accordance with the present invention, such as depicted in FIGS. 1A–B, 9A–C and 11, also can include a structure designed to make it easier for the user to carry the dispenser. For example, FIG. 1A depicts a clip 138 similar to that found on a pen. This clip 138 allows the user to secure the dispenser in a pocket. Another possible structure is a tang, such as the tang 114 depicted in FIGS. 9A–C and the tang 140 depicted in FIG. 11. These tangs 114, 140 extends from the back side of the dispenser and include a through-hole 116, 142. The through-hole 116, 142 can be used to attach a chain, for example one which can be used to hang the dispenser around the user's neck. Alternately, the through-hole 116, 142 could be used to attach a ring or short chain which can be employed to hang the dispenser from a necklace or a keychain. Of course, the clip 138 shown in FIGS. 1A–B could be used in the embodiments of FIGS.

9A–C and 11, or the tang 114, 140 of FIGS. 9A–C and 11, could be employed in the embodiment of FIGS. 1A–B. In addition, other structures, as appropriate, could be employed rather than those shown in the figures, or if desired, the dispenser may omit the aforementioned facilitating structure all together.

Figure 13:
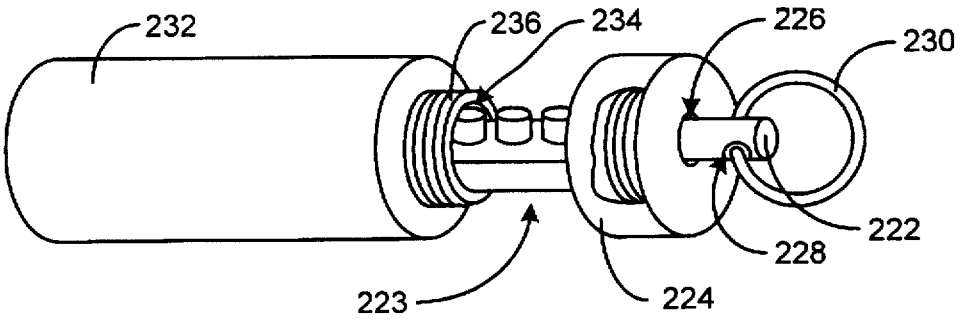
FIG. 13 is a perspective view of a protective sleeve and cap for use with a modified version of the pill dispenser of FIG. 11.
Figure 14:
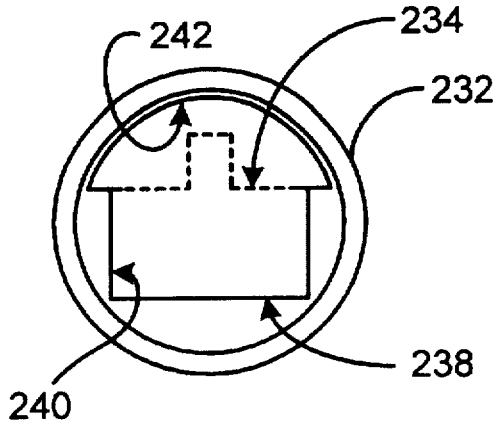
FIG. 14 is a lateral cross-sectional view of the protective sleeve of FIG. 13.

Although practical for many applications, such as when the dispenser is worn on a chain around the neck of the user, the embodiment described in connection with FIG. 11 (and to a lesser extent the embodiment of FIG. 12), does leave the pill chambers somewhat exposed to being inadvertently breached. For example, one of the plungers could be actuated prematurely by coming into contact with some object, or the sealing membrane covering the bottom of a pill chamber could be punctured by an object protruding up thorough one of the dispenser openings in the lower part of the housing. These situations might occur where the dispenser is carried on a key chain and placed in one's pocket or in a handbag. For instance, the aforementioned object might be a pen or key also contained in the pocket or handbag. The foregoing problem can be resolved by installing the dispenser in a protective sleeve which encloses the dispenser when not in use, but allows ready access to it when a pill is to be dispensed. Although, this protective sleeve can take many on many forms, one preferred version is shown in FIG. 13. In this version, the dispenser is modified so as to include cylindrical post 222 extending from the back end of the dispenser 223 along the longitudinal centerline of the device. Installed onto the post 222 is a cap 224. This cap 224 has a centrally located hole 226 through its closed end which has a diameter just slightly larger than that of the post 222. The post 222 extends through this hole 226 and the cap 224 is to free to rotate on the post. The cap 224 is prevented from sliding off the post 222 by a retaining device located at the distal end of the post. Preferably, this retaining device takes the form of a laterally oriented through-hole 228 located toward the distal end of the post 222 and a ring 230 installed through this hole. The ring 230 not only prevents the cap 224 from sliding off the post 222, but can be used as a convenient attachment point to install the dispenser 223 on a keychain, necklace, or the like. The sleeve 232 is closed at its back end and open at its front end. It can have a cylindrical exterior shape as depicted in FIG. 13. However, this need not be the case. The sleeve 232 could have other appropriate shapes as desired. The sleeve 232 also has a longitudinal chamber 234 running from the open end of the sleeve toward its closed end. The pill dispenser 223 slides into this chamber 234 and the chamber is long enough so that the entire dispenser can be placed therein, with the exception of the post 222. The post 222 extends out of the open end of the chamber 234 when the dispenser 223 is installed. Adjacent the open end of the sleeve 232 is a threaded section 236 having a smaller external diameter than the remainder of the sleeve. The diameter and length of this threaded section 236, as well as the type of threads employed, are designed to threadably mate with the cap 224. Thus, when the dispenser 223 is fully installed within the sleeve 232, the cap 224 can be slid back along the post 222 toward the threaded extension 236 of the sleeve, and thereafter screwed on to the threaded extension of the sleeve. This secures the pill dispenser 223 within the sleeve 232, thereby preventing access to the pill chambers by any protruding objects. When a user wishes to ingest a pill, the cap 224 is simply rotated in respect to the sleeve 232 until it is free. The user can then pull on the cap 224 and slide the dispenser 223 either partially or completely out of the sleeve 232 to dispense one of the pills. The sleeve chamber 234 may have any appropriate cross-sectional shape, for example round. However, it is preferred that the cross-sectional shape of the chamber 234 be such that it enhances the ability to slide the dispenser 223 in and out of the sleeve 232. As best seen in FIG. 14, the cross-section of the chamber 234 can have a flat bottom 238 with short vertical walls 240 which transition into a partial circular portion 242. The bottom 238 and vertical side walls 240 are sized to be just slightly larger than that of the width and height of the dispenser (shown in dashed lines), respectively. The dispenser slides into the sleeve 232 with its bottom surface against the bottom 238 of the chamber, and its sides against the vertical side walls 240 of the chamber. The partial cylindrical portion 242 of the chamber surrounds the top of the dispenser without making contact or interfering therewith.

Even though the pill dispenser associated with FIG. 13 has been described as employing a separate pill carrier, it is possible to integrate the pills into the dispenser housing itself because there is no need to index the pill carrier. In one version of the integrated embodiment, the pill carrier slot would be replaced with a permanently installed pill carrier. In another version, a single piece housing design would be employed wherein the previously described pill pack (of FIG. 4) would be integrated directly into the housing with the pills being suspended in-between the plunger chambers and the dispenser openings.

Figure 15:
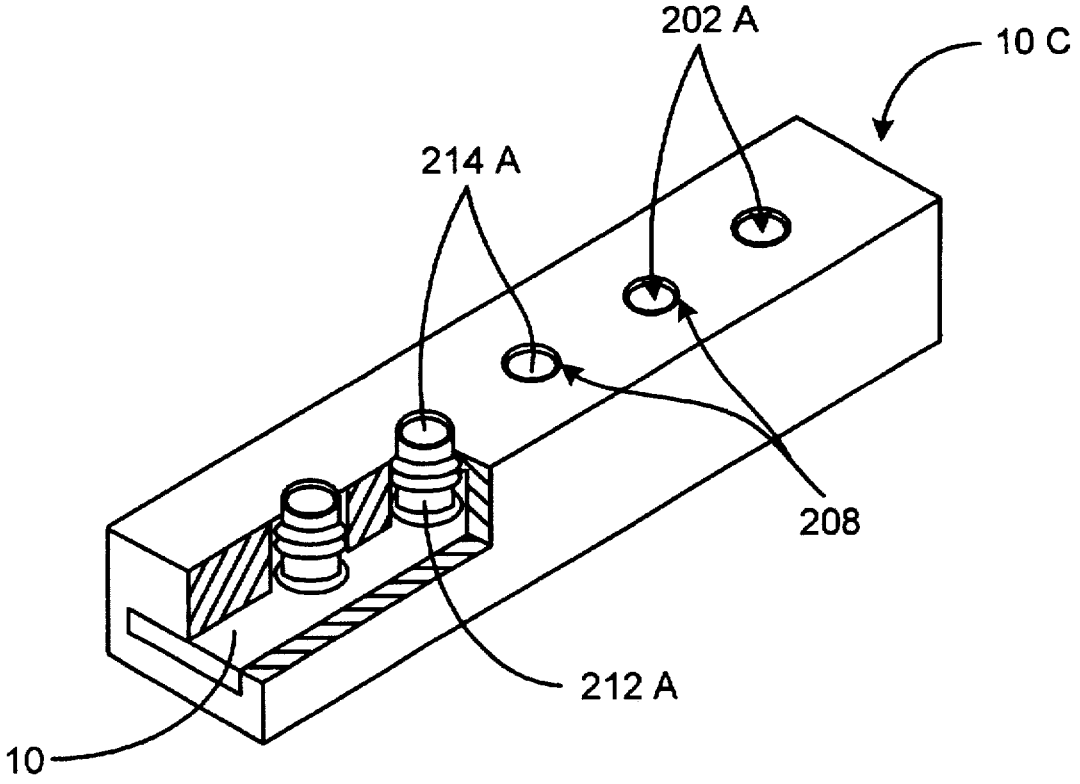
FIG. 15 is a partially cut-away perspective view of yet another embodiment of a pill carrier constructed in accordance with present invention.

A pill carrier embodiment similar in design to the just-described integrated dispenser is also envisioned according to the present invention. In all the pill dispenser embodiments discussed so far, there is a need for a relatively precise alignment of the plunger or plungers with the pill chambers of the pill carrier in order to ensure the pills are dispensed properly. A pill carrier 10*c*, such as the one depicted in FIG. 15, is more insensitive to misalignments. In this embodiment, the pill carrier 10*c* is constructed much the same as the pill dispenser associated with FIG. 11 with a permanently integrated pill carrier 10*a* 10*b* of either the design depicted in FIG. 2A–B or FIG. 3. The difference lies in that the actuator section 214*a* of each of the plungers 202*a* is shorter such that it is flush with or even slightly recessed into the plunger holes 208. In addition, all appendages used to facilitate carrying the dispenser of the previous embodiment are absent so as to form the rectangular block shape required of the pill carrier 10*c*. This embodiment of the pill carrier 10*c* is installed and used like the other pill carrier embodiments in the dispenser of FIGS. 1A–B or FIGS. 9A–C. However, the punch head 212*a* employed on these dispensers is modified to be smaller in cross-section than that of the pill chambers. Thus, even if the pill chambers of the carrier 10*a*, 10*b* were not exactly centered over the plunger head 212*a*, the plunger head would still contact the actuator section 214*a* of the plunger and depress the plunger 202*a* to dispense a pill. Accordingly, the interface between the dispenser housing and the pill carrier 10*c* need not be as precise as with the other embodiments of the present invention. In addition, the face of the plunger head 212*a* can be flat as an angled face is not required.

The materials chosen for the dispenser housing and pill carrier must provide the aforementioned protection for the pills, including isolation from harmful external environmental factors (e.g. shock, vibration, heat, moisture, humidity, and light), and be non-reactive to the pills. The preferred materials for providing these requirements are plastics, preferably Teflon, and metals, preferably aluminum. In addition, combinations of Teflon and aluminum are envisioned. For example, the pill carrier can be made of aluminum while the housing is Teflon. It is even possible to employ an aluminum coating on a Teflon part. For example, where direct contact with Teflon would not be feasible due to its reacting with the medication in the pills, such as could be the case where the pill carrier of FIG. 2 is employed, a non-reactive aluminum coating could be employed, at least on the walls of the pill chambers. Further, recent advances have made it possible to coat aluminum surfaces with Teflon. Therefore, Teflon coated aluminum parts are another possibility. This has advantages as Teflon surfaces slide easily against one another, even in a jam fit condition. This would make the movement between the pill carrier and the dispenser housing easier. Additionally, Teflon resists the wicking of moisture. This, therefore, helps to keep water out of the interior of the dispenser. In addition, shallow moat-like moisture traps (not shown) could surround each pill chamber in a dispenser having both the housing and pill carrier made of Teflon or a Teflon coated material. These traps further prevent moisture from reaching the pills. Teflon and aluminum materials are also both light in weight. Thus, the dispenser is made easier to carry. In addition, these materials are opaque so that light cannot penetrate and degrade the pills effected by light.

There is a case, however, where an opaque material such as Teflon or aluminum is not desired. If the pills are not affected by light, it could be desirable to make the pill carrier and dispenser housing out of a transparent material, such as a transparent plastic, which is not reactive to the pills. This allows the user to see the pills within the dispenser to determine how many remain.

While the invention has been described in detail by reference to the preferred embodiment described above, it is understood that variations and modifications thereof may be made without departing from the true spirit and scope of the invention. For example, all the embodiments of a pill dispenser made in accordance with the present invention described so far employ linear pill carriers where the pills form a straight line. This need not be the case. The pill carrier could be circular for example and the pill chambers disposed about its periphery. In this case, the pill carrier would be indexed by rotating a pill chamber into alignment with the punch mechanism. Even a circular dispenser embodiment employing multiple plungers is feasible. Further, the dispensers of the present invention could be colorized or color coded. A particular color or color pattern would indicate the kind of pills carried in the dispenser. This could be very useful to a person who must carry more than one type of medication with them. For example, the dispenser's housing could be colored or color coded. Alternately, the housing could be made of a transparent plastic and the pill carrier could be colored or color coded. Further, the color or color coding employed could be made to match that used by the pill manufacture on the pills themselves.

Wherefore, what is claimed is:

1. A pill dispenser comprising:

a pill carrier having a plurality of through-holes comprising pill chambers, each pill chamber at least initially holding a pill which is sealed from the outside environment and completely contained within the pill chamber;

a dispenser housing comprising, a pill carrier slot into which said pill carrier is disposed, and a pill dispensing channel forming a pathway from the slot to the exterior of the dispenser housing, wherein said pill carrier is displaceable within said slot to sequentially align each of said pill chambers with said channel; and a plunger apparatus disposed adjacent said slot and opposite said channel and capable of extending into a pill chamber which is in alignment with the channel so as to push a pill contained within the pill chamber into the channel for dispensing to the exterior of the housing.

2. The pill dispenser of claim 1, wherein the pill carrier further comprises first and second sealing membranes covering the top and bottom of each pill chamber respectively so as to seal a pill held within the pill chamber from the outside environment.

3. The pill dispenser of claim 1, wherein a pill held within a pill chamber of the pill carrier is sandwiched between two sealing membranes capable of sealing the pill from the outside environment and suspended by these membranes from the wall of the pill chamber.

4. The pill dispenser of claim 3, wherein the sealing membranes and pills form a continuous pill pack comprising a plurality of pills which are individually sandwiched between the sealing membranes at prescribed separation distances from adjacent pills, said prescribed separation distances corresponding to the separation distances between pill chambers of the pill carrier.

5. The pill dispenser of claim 4, wherein the pill carrier has an upper portion comprising the upper sections of the pill chambers, and a lower portion comprising the lower sections of the pill chambers, and wherein the upper and lower portions of the pill carrier are separable from one another to the extent necessary to allow the pill pack to be inserted between or removed from the upper and lower pill carrier portions.

6. The pill dispenser of claim 1, wherein the pill carrier further comprises plungers disposed in an upper portion of each pill chamber, said plungers being flush with or slightly recessed from the top surface of the pill carrier.

7. The pill dispenser of claim 6, wherein the pill carrier further comprises first and second sealing membranes overlying and underlying a pill in each pill chamber respectively so as to seal the pill from the outside environment, said first and second membranes and said pill being disposed underneath the plunger associated with the pill chamber.

8. The pill dispenser of claim 6, wherein a pill held within a pill chamber of the the pill carrier is sandwiched between two sealing membranes capable of sealing the pill from the outside environment and suspended by these membranes from the wall of the pill chamber, said sealing membranes and said pill being disposed underneath the plunger associated with the pill chamber.

9. The pill dispenser of claim 1, wherein the cross-section of each pill chamber defined in reference to any plane lying perpendicular to the longitudinal centerline of the through-hole forming the pill chamber, hereinafter referred to as a horizontal cross-section, is uniform over the entire length of the through-hole and has a shape substantially the same as that of a horizontal cross-section of a pill held within the chamber corresponding to the pill's maximum cross-sectional dimensions.

10. The pill dispenser of claim 9, wherein the dimensions of the uniform horizontal cross-section of each pill chamber in comparison to the maximum cross-sectional dimensions associated with the horizontal cross-section of a pill held therein is made small enough to minimize the movement of the pill within the chamber but large enough to ensure the pill can be pushed from the chamber without becoming jammed so as to cause damage to the pill.

11. The pill dispenser of claim 1, wherein the pill carrier further comprises first and second sealing membranes overlying and underlying a pill in each pill chamber respectively so as to seal the pill from the outside environment, and wherein said second sealing membrane underlying the pill in each pill chamber comprises a pattern of weakened areas, said weakened areas being designed to fail under a force from the pill to allow the pill so as to pass through the second sealing membrane, said force being low enough to ensure the pill is not damaged prior to the lower membrane failing at the weakened areas.

12. The pill dispenser of claim 11, wherein the pattern associated with the weakened areas of the lower membrane is designed to ensure that the portions of the second sealing membrane adjacent the weakened areas remain attached to the membrane after the weakened areas have failed.

13. The pill dispenser of claim 1, wherein the plunger apparatus comprises:

a punch head designed to extend into a pill chamber and push a pill held therein into the pill dispensing chamber whenever the plunger apparatus is actuated by a user; and a biasing member capable of maintaining the punch head in a retracted position clear of the pill chamber prior to and after actuation of the plunger apparatus by the user.

14. The pill dispenser of claim 13, wherein the cross-section of each pill chamber defined in reference to any plane lying perpendicular to the longitudinal centerline of the through-hole forming the pill chamber, hereinafter referred to as a horizontal cross-section, has substantially the same shape as the horizontal cross-section of the punch head, when extended into the pill chamber, at the punch head's maximum cross-sectional dimensions.

15. The pill dispenser of claim 13, wherein the cross-section of each pill chamber defined in reference to any plane lying perpendicular to the longitudinal centerline of the through-hole forming the pill chamber, hereinafter referred to as a horizontal cross-section, is just sufficiently larger than the maximum cross-sectional dimensions of the horizontal cross-section of the punch head when extended into the pill chamber so as to ensure the punch head does not become jammed within the chamber to the extent that the biasing member cannot return the punch head to its retracted position after activation of the plunger apparatus by the user is complete.

16. The pill dispenser of claim 13, wherein the pill carrier further comprises first and second sealing membranes overlying and underlying a pill in each pill chamber respectively so as to seal the pill from the outside environment, and wherein the length of the punch head in the direction of its extension into a pill chamber is limited to that which will cause the distal end of the punch head to contact the first membrane and push the pill through the second sealing membrane without tearing free any part of the first or second membrane whenever the punch head is fully extended into the pill chamber.

17. The pill dispenser of claim 13, wherein the punch head comprises an angled face at its distal end, said angled face resulting in progressive contact by the angled face of the punch head with a sealed pill in a pill chamber whenever the punch head is extended into the pill chamber.

18. The pill dispenser of claim 13, wherein the punch head comprises one of (i) a flat face, or (ii) a curved face at its distal end.

19. The pill dispenser of claim 1, further comprising an indexing mechanism capable of displacing the pill carrier within the pill carrier slot to sequentially align each pill chamber with the pill dispensing channel.

20. The pill dispenser of claim 19, wherein the indexing mechanism comprises a detent mechanism and stops, said detent mechanism comprising an interfacing member which interfaces with stops formed periodically in the dispenser housing, thereby causing the pill carrier to be releasable held at one of plural index locations with respect to the pill carrier slot, said index locations each corresponding to a position wherein one of the pill chambers of the pill carrier is in alignment with the pill dispensing channel of the dispenser housing.

21. The pill dispenser of claim 20 wherein the interfacing member comprises at least one protrusion from the detent mechanism and the stops each comprise an indentation in the dispenser housing into which the at least one protrusion is capable of extending into, thereby holding the pill carrier in position relative to the pill carrier slot.

22. The pill dispenser of claim 21, wherein the detent mechanism further comprises a release which under a force applied by a user, retracts the at least one protrusion from a stop into which it is extended, thereby allowing the pill carrier to be moved in relation to the pill carrier slot.

23. The pill dispenser of claim 19, wherein the indexing mechanism comprises a screw advance mechanism having a shaft and a rotatable housing, said shaft interfacing with an aft end of the pill carrier, and which, in response to a user's rotation of the rotatable housing pushes the pill carrier forward in the pill carrier slot.

24. The pill dispenser of claim 23, wherein the indexing mechanism further comprises indicia associated with the rotatable housing which allows a user to determine when the rotatable housing has been rotated a sufficient amount to align one of the pill chambers with the pill dispensing channel.

25. The pill dispenser of claim 19, wherein the indexing mechanism comprises a click advance mechanism having tines which interface with indentations in the sides of the pill carrier, and which, in response to a user's pressing of a advancing button pushes the pill carrier forward in the pill carrier slot.

26. The pill dispenser of claim 1, wherein the pill chambers of the pill carrier are spaced from each other and the pill carrier is segmented such that each pill chamber is formed within a separate segment of the pill carrier, and wherein the pill carrier segments are separable from each other.

27. The pill dispenser of claim 26, wherein the pill carrier segments are separable form each other owing to a weakened area which forms the connection between adjacent segments, said weakened area being susceptible to failure under a bending force applied by the user so as to cause a separation between adjacent segments.

28. The pill dispenser of claim 26, wherein the pill carrier segments are separable from each other owing to releasable interlocking structures formed on the interfacing ends of each adjacent segments, said interlocking structures being capable of connecting and holding adjacent segments together and of releasing under a force applied by a user thereby causing a separation between adjacent segments.

29. The pill dispenser of claim 26, wherein a front end of the pill carrier slot is open to the exterior of the housing and the displacement of the pill carrier within the slot can cause a portion of the pill carrier to extend out from the open end of the slot, and wherein, whenever the displacement of the pill carrier within the pill carrier slot causes a portion of the pill carrier to extend from the front end thereof, the separable segments of the pill carrier are configured so that a user can separate substantially all of that portion of the pill carrier extending from the front end of the pill carrier slot from the remaining portion of the pill carrier.

30. The pill dispenser of claim 1, further comprising an attachment structure having through-hole, said through-hole being sized so as to allow the pill dispenser to be attached by the attachment structure to one of a necklace or a keychain.

31. The pill dispenser of claim 1, further comprising a pocket clip configured to allow the pill dispenser to be secured within a pocket of a user.

32. The pill dispenser of claim 1, wherein the dispenser housing and pill carrier are formed from a plastic material.

33. The pill dispenser of claim 1, wherein:

the dispenser housing is formed from one of (i) transparent plastic, (ii) Teflon, (iii) aluminum, (iv) Teflon coated aluminum, (v) aluminum coated Teflon.

34. The pill dispenser of claim 1, wherein:

the pill carrier is formed from one of (i) transparent plastic, (ii) Teflon, (iii) aluminum, (iv) Teflon coated aluminum, (v) aluminum coated Teflon.

35. A pill dispenser comprising:

a pill carrier having a plurality of through-holes comprising pill chambers, each pill chamber at least initially holding a pill which is sealed from the outside environment and completely contained within the pill chamber;

a dispenser housing comprising, a pill carrier slot into which said pill carrier is disposed, and a plurality of pill dispensing channels forming individual pathways from the slot to the exterior of the dispenser housing, and wherein, each of said pill chambers is in alignment a different one of the plurality of pill dispensing channels; and a plurality of plungers, each of said plungers being disposed adjacent said pill carrier slot and opposite a different one of said plurality of pill dispensing channels and capable of extending into a pill chamber which is in alignment with the associated channel so as to push a pill contained within the pill chamber into the associated channel for dispensing to the exterior of the housing.

36. The pill dispenser of claim 35, wherein the pill carrier further comprises first and second sealing membranes covering the top and bottom of each pill chamber respectively so as to seal a pill held with the pill chamber from the outside environment.

37. The pill dispenser of claim 35, wherein a pill held within a pill chamber of the pill carrier is sandwiched between two sealing membranes capable of sealing the pill from the outside environment and suspended by these membranes from the wall of the pill chamber.

38. The pill dispenser of claim 35, wherein the pill carrier slot comprises a front end open to the exterior of the housing, and the pill carrier is a separate unit capable of being inserted and removed from the pill carrier slot through the slot's open front end.

39. The pill dispenser of claim 38, wherein the pill carrier slot comprises a closed back end, said closed back end being displaced a distance from the rearmost pill dispensing channel which results in each pill chamber aligning with a different pill dispensing channel whenever a back end of the pill carrier is abutted against the closed back end of the pill carrier slot.

40. The pill dispenser of claim 39, wherein the length of the pill carrier is such that whenever its back end is abutted against the closed back end of the pill carrier slot, a front end of the pill carrier is substantially flush with a front end of the dispenser housing, thereby providing an indicia that the pill carrier is fully seated and each pill chamber is in alignment with its associated pill dispensing channel.

41. The pill dispenser of claim 38, wherein the pill carrier slot and pill carrier are sized so as to form a jam fit therebetween in the lateral direction whenever the pill carrier is installed within the slot, thereby retaining the pill carrier within the slot.

42. The pill dispenser of claim 35, wherein the pill carrier is integral to the pill dispenser housing and cannot be removed therefrom.

43. The pill dispenser of claim 35, wherein each plunger comprises:

an actuator; and a punch head designed to extend into a pill chamber and push a pill held therein into the associated pill dispensing chamber whenever the actuator is depressed by a user.

44. The pill dispenser of claim 43, wherein the actuator extends away from the exterior surface of the dispenser housing, and wherein the housing comprises plural depressions, the bottom of each of which coincides with the point of egress of a different one of the plunger actuators and a top of which is higher than the maximum distance the associated actuator is capable of extending from the housing, said depressions being sized so as to allow a user access to fully depress the actuator with a finger.

45. The pill dispenser of claim 43, wherein the pill carrier further comprises first and second sealing membranes overlying and underlying a pill in each pill chamber respectively so as to seal the pill from the outside environment, and wherein the length of the punch head in the direction of its extension into a pill chamber is limited to that which will cause the distal end of the punch head to contact the first membrane and push the pill through the second sealing membrane without tearing free any part of the first or second membrane, whenever the punch head is fully extended into the pill chamber.

46. The pill dispenser of claim 43, wherein each plunger further comprises a flange disposed between the actuator and the punch head, said flange having a larger diameter than that of the actuator and punch head, and wherein in a retracted position, the punch head and flange are disposed completely within a plunger chamber, said plunger chamber having through-hole at an upper end thereof with a smaller diameter than that of the plunger chamber wherein the actuator extends through the hole to the exterior of the housing and the flange abuts the upper end of the chamber, and wherein the diameter of the flange is such that it forms a jam fit with the wall of the plunger chamber, said jam fit being tight enough to retain the plunger in the retracted position absent a downward force being applied to the actuator by a user, and wherein in an extended position resulting from the user depressing the actuator of the plunger in its retracted position, the flange abuts the top of the pill carrier thereby limiting the extension of the punch head into the associated pill chamber, said jam fit retaining the plunger in its extended position thereby providing indicia that a pill has been dispense from the associated pill chamber.

47. The pill dispenser of claim 35, further comprising a protective sleeve and cap, wherein said protective sleeve has an internal cavity with an open end and is capable of encasing the dispenser housing when inserted into the cavity of the sleeve, and wherein said cap is releasably mateable with the open end of the sleeve so as to retain the dispenser housing within the sleeve when the cap is mated with the sleeve and allow a user to extract the dispenser housing from the sleeve when the cap is released from the sleeve.

48. The pill dispenser of claim 35, wherein the dispenser housing and pill carrier are formed from a plastic material.

49. The pill dispenser of claim 35, wherein:

the dispenser housing is formed from one of (i) transparent plastic, (ii) Teflon, (iii) aluminum, (iv) Teflon coated aluminum, (v) aluminum coated Teflon.

50. The pill dispenser of claim 35, wherein:

the pill carrier is formed from one of (i) transparent plastic, (ii) Teflon, (iii) aluminum, (iv) Teflon coated aluminum, (v) aluminum coated Teflon.

51. A pill dispenser comprising:

a pill carrier having a top side and a bottom side, each characterized by a substantially level, continuously even surface with the exception of periodic openings in the surface corresponding to a plurality of holes comprising pill chambers extending through the pill carrier between the top and bottom surfaces, wherein each pill chamber at least initially holds a pill which is sealed from the outside environment and completely contains the pill within the pill chamber such that the pill does not extend above or below the top and bottom surfaces of the pill carrier respectively;

a dispenser housing comprising, a pill carrier slot into which said pill carrier is disposed; and a pill dispensing channel forming a pathway from the slot to the exterior of the dispenser housing, wherein said pill carrier is displaceable within said slot to sequentially align each of said pill chambers with said channel; and a plunger apparatus disposed adjacent said slot and opposite said channel and capable of extending into a pill chamber which is in alignment with the channel so as to push a pill contained within the pill chamber into the channel for dispensing to the exterior of the housing.

* * * * *